United States Patent [19]

Langer

[11] Patent Number: 4,809,907

[45] Date of Patent: Mar. 7, 1989

[54] CONTAINER

[76] Inventor: Karen J. Langer, 8641 Lookout Mountain, Los Angeles, Calif. 90046

[21] Appl. No.: 189,481

[22] Filed: May 2, 1988

[51] Int. Cl.[4] ..... B65D 5/24

[52] U.S. Cl. ..... 229/145; 229/152; 229/154; 229/173; 229/186

[58] Field of Search ..... 229/145, 152, 154, 172, 229/173, 186, DIG. 4

[56] References Cited

U.S. PATENT DOCUMENTS

| | | | |
|---|---|---|---|
| 598,344 | 2/1898 | Ingrey | 229/145 |
| 705,953 | 7/1902 | Neihysel | 229/173 |
| 998,497 | 7/1911 | Goodyear | 229/172 |
| 1,068,802 | 7/1913 | Merrell et al. | 229/154 |
| 2,124,335 | 7/1938 | Klein | 229/152 |
| 2,753,103 | 7/1956 | Van Rosen et al. | 229/172 |
| 2,847,154 | 8/1958 | Frankenstein | 229/145 |
| 3,311,285 | 3/1967 | Korr | 229/145 |
| 4,361,236 | 11/1982 | Lavery | 229/172 |

FOREIGN PATENT DOCUMENTS

| | | | |
|---|---|---|---|
| 1027588 | 4/1958 | German Democratic Rep. | 229/152 |
| 47831 | 4/1930 | Norway | 229/145 |

*Primary Examiner*—Stephen Marcus
*Assistant Examiner*—Gary E. Elkins
*Attorney, Agent, or Firm*—Bruce L. Birchard

[57] ABSTRACT

A slot-less, one-piece container formed of scored cardboard, or its equivalent, the shape of such container being sustained by locking flaps which form interference fits with contiguous side-wall members and one of which simultaneously overlaps bellows-folded joining members between side members to keep the side-wall members in normal relationship to a base member, the locking flaps being in opposing pairs, each pair having a pair of abutting end members, one pair of end members lying on the base portion and the other pair of end members lying on the cover portion of the container.

6 Claims, 1 Drawing Sheet

CONTAINER

BACKGROUND OF THE INVENTION

1. Field of the Invention

This invention relates to containers formed from cardboard, or the like, and, more specifically, to such containers which retain their shapes without fasteners of any type.

2. Prior Art

Numerous containers appear in the prior art. For example, U.S. Pat. No. 2,443,431 (Ringler) and U.S. Pat. No. 615,417 (Wilcox). However, the containers covered by those patents require tabs (Ringler) or do not achieve minimal folds to complete fabrication (Wilcox).

Therefore, it is an object of this invention to overcome the various problems of the prior art devices.

It is a further object of this invention to provide a container which requires a minimum number of steps for its formation and which presents a smooth contour when assembled, without using tabs, slots and/or external retaining means.

SUMMARY OF THE INVENTION

By configuring and scoring the blank from which the container is formed so that locking flap members form interference fits with side wall members, a complete, self-sustaining cubical container with a wholly smooth outer surface is formed without tabs, slots or foreign fastening means of any kind. The container so formed is relatively inexpensive to produce and is pleasing to the eye as well as being utilitarian.

BRIEF DESCRIPTION OF THE DRAWINGS

This invention and its method of operation can best be understood by reading the description which follows in conjunction with the drawings herein, in which.

DETAILED DESCRIPTION OF THE PREFERRED EMBODIMENT

Figure 1:
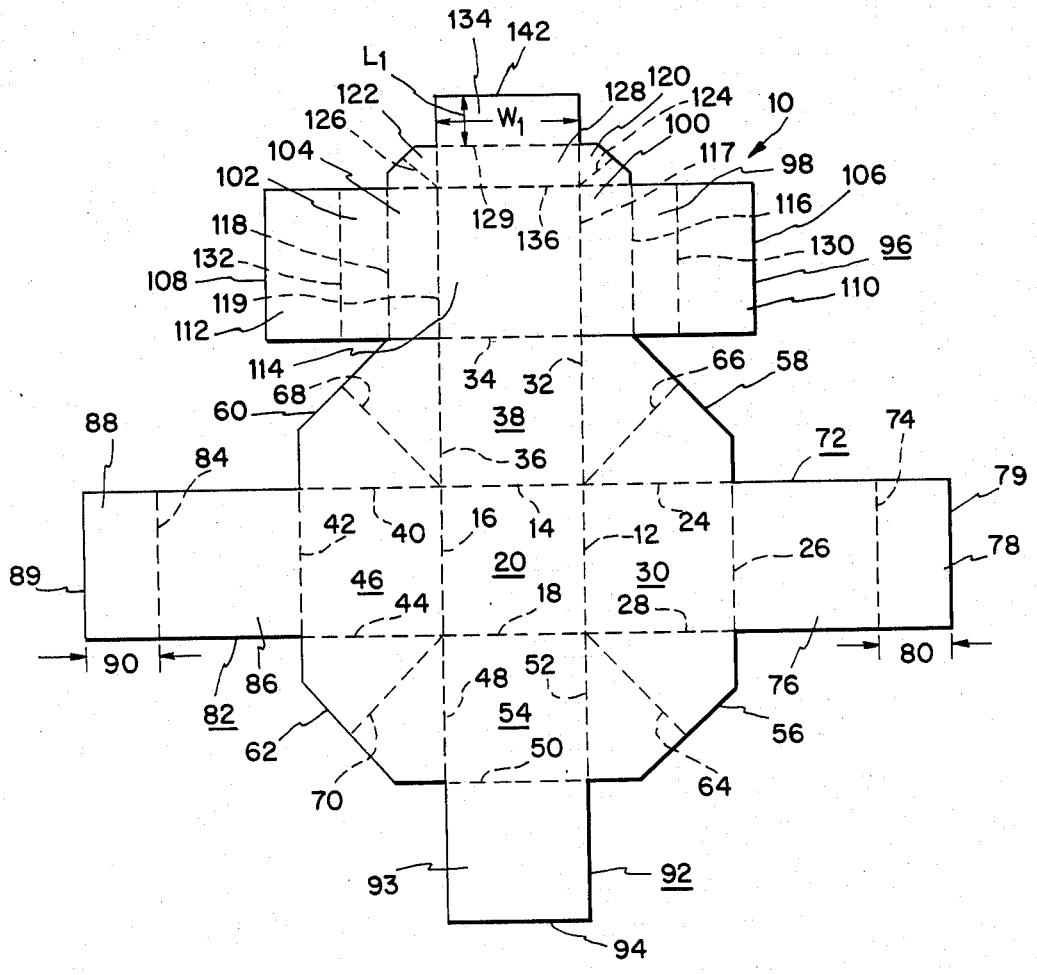
FIG. 1 is a top plan view of the container according to this invention, before assembly; and, FIG. 2 is an orthogonal view of a completely formed container according to the present invention.

In FIG. 1, blank 10 is made of paperboard, or the like. As can be seen from FIG. 1, blank 10, being flat, can be shipped conveniently in stacks of blanks to effect savings in transportation costs. Also, economies can be realized in storage of the blanks by a user, such as a department store. The material of blank 10 may be impregnated or otherwise treated to properly contain the substance to be packed therein.

The selected paperboard or fiberboard, in the form of large sheets or rolls, is usually imprinted on one side thereof only, which side forms the exterior surface of the assembled container. The opposite or inner forming side of the board may, if desired, be suitably lined or treated to adequately protect the contents. The imprinted board may then be run through a cutting and scoring press which cuts out the marginal outline of the respective container-forming blanks and forms in each such blank the proper arrangement of scoring lines. The prepared blanks ejected from the cutting and scoring machine are then ready for shipment to the user.

The user, packer or merchandise manufacturer assembles each blank as needed into a complete container. The blank is so creased, shaped and formed in advance that the same may be set up into container form by a few simple manipulations and requires no staples, glue, stitches, or like holding means for retaining the same in rigid assembled container form. The container as assembled presents a four-sided parallelepiped or, more specifically, cubical construction with the bottom wall and the front, rear and side walls integrally and unbrokenly connected by scoring lines. The interior and exterior of the container presents smooth wall surfaces free from any irregularities.

More specifically, blank 10 has scoring lines 12, 14, 16 and 18 which are on what is intended to be the inside of the box ultimately formed from blank 10. These scoring lines outline the base element 20 of the box or container 22 shown in FIG. 2.

The scoring lines 12, 24, 26 and 28 outline side 30 of container 22. The scoring lines 14, 32, 34 and 36 outline side 38 of container 22. The scoring lines 16, 40, 42 and 44 outline side 46 of container 22. And, the scoring lines 18, 48, 50 and 52 outline side 54 of container 22.

The scoring lines 12, 14, 16, 18, 24, 28, 32, 36, 40, 44 and 48, 52 are shown equal in length because the ultimate container formed from blank 10 is intended to be cubical in shape Joining elements 56, 58, 60 and 62 have diagonal scoring lines 64, 66, 68 and 70, respectively, therein to permit a bellows-type of folding of the joining elements inwardly of the container 22. To ease the bellows-folding process, blank 10 may be perforated along those scoring lines, 64, 66, 68 and 70 or the perforations substituted for those scoring lines. Side flap 72 has a scoring line 74 located so the element 76 has the dimensions of side 30 and element 78 has a length 80 which is one-half of the length of scoring line 18 on base 20.

Retainer flap 92 has a scoring line 50 located so that element 93 has the same dimensions of side 54.

When blank 10 is folded properly, sides 30, 38, 46 and 54 are normal to base 20, joining elements 56 and 58 are folded inwardly at bellows-fold scoring lines 64 and 66, respectively, and lie over the inner surface of side 30. Side flap 72, folded along scoring line 26 overlaps bellows-folded joining elements 56 and 58 and frictionally engages the inner surfaces of sides 38 and 54. Element 78, formed by the folding of side retainer flap 72 at scoring line 74, lies on the inner surface of base 20, extending one-half of the distance across base element 20.

Similarly, joining elements 60 and 62 are folded inwardly at bellows-fold scoring lines 68 and 70, respectively, and overlie the inner surface of side 46. Side flap 82 is folded along scoring lines 42 and 84 which are located so that element 86 has the dimensions of side 46 and element 88 has a length 90 which is one-half of the length of scoring line 18. Element 86 forms an interference fit within sides 38 and 54, thus holding it in position with the leading edges 79 and 89 of elements 78 and 88, respectively, abutting.

Retainer flap 92 is folded inwardly over side 54. When so folded, retainer flap 92 engages, with an interference fit, the adjacent sides 30 and 46 of the container 22 (FIG. 2) and its leading edge 94 engages the abutting elements 78 and 88, holding them on the base element 20.

To complete the formation of container 22 (FIG. 2), cover portion 96 of blank 10 is folded, as follows.

Elements 100, 104 and 128 are folded inwardly (toward the viewer of FIG. 1) to an attitude normal (90 degrees) to cover element 114. This folding step necessitates the bellows-folding of joining elements 120 and 122 along scoring lines 124 and 126, respectively, with the result that joining element 120 lies on element 100 and joining element 122, as a result of inward bellows-folding along scoring line 126, lies on element 104.

The folding of closure element 98 at scoring line 116 results in its overlying bellows-folded joining element 120 (which is lying on element 100) and in its retaining the normal (90 degrees) attitude of element 100 with respect to cover element 114. At the same time, outer element 110 folds along scoring line 130 with the result that it lies snugly on the inner surface of cover element 114. Similarly, when closure element 102 is folded over element 104 along scoring line 118, joining element 122 which, as a result of bellows-folding along scoring line 126 is lying on element 104, is held in that position by closure element 102. At the same time outer element 112 folds along scoring line 132 and lies on the inner surface of cover element 114.

The extreme edges 106 and 108 of outer elements 110 and 112 will then abut each other along the center line of cover element 114, the widths of elements 98, 100, 102 and 104 being equal and the width of elements 110 and 112 being one-half the width of cover element 114.

Figure 2:
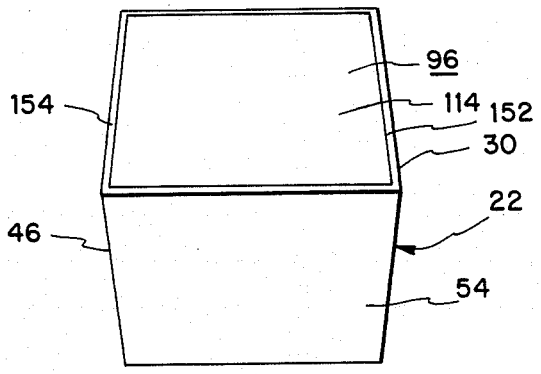

The overlapped elements 98, 100 and 102, 104 form closure edges 152, 154 (FIG. 2).

To complete the formation of cover portion 96, lip element 134 is folded inwardly (towards the viewer of FIG. 1) and into a position where it overlaps element 128. The width "$W_1$" of lip element 134 is such that it forms an interference fit within closure edges 152, 154 (FIG. 2) of container 22. The length "$L_1$" of lip element 122 is equal to the length of element 128 so that leading edge 142 engages and holds in place the abutting edges 106 and 108 of outer elements 110 and 112, respectively, thus assuring the retention of the shape of cover portion 96.

The outer width $W_1$ of cover portion 96 is slightly less than the inner width of base element 120, the width of which is represented by the lengths of scoring lines 14 and 18, to assure insertability of cover portion 96, but with a snug or interference fit.

It should be noted that scoring lines 74, 84 and 130 and 132 are on the outside of container 22, i.e. on the side of blank 10 opposite to that which the viewer sees in FIG. 1. Further, double scoring may be required if blank 10 is made of thick material.

In FIG. 2 the completed container is shown. It may be seen that that it is a smoothly contoured, aesthetically attractive container. The discussion which has just been completed shows that the container is easily assembled and inexpensive to manufacture. This combination assures commercial success for the container according to my invention.

While a particular embodiment has been shown and described, it will be apparent to those skilled in the art that variations and modifications may be made therein without departing from the spirit and scope of my invention. It is the purpose of the appended claims to cover all such variations and modifications.

I claim:

1. A slot-less, one-piece container having a self-sustaining shape including rectangular bottom, top and first, second, third and fourth side portions;

said first and third side portions opposing each other and each including a side element and an integral side-flap element, each of said side-flap elements, in use, overlapping its respective side element for the extent thereof and having a flexibly connected securing section extending over said bottom portion one-half of the width thereof, whereby said securing sections abut each other;

said second side portion having a second-side element extending from the entire length of one edge of said bottom portion for an extent equivalent to the length of said first and third side elements, respectively, and having a second flap element extending from said second side element at the edge thereof remote from said bottom portion and having the dimensions of said second side element;

said second side element having its two remaining sides joined to respective proximate edges of said first and third side elements by respective first and third joining elements each including a bellows-type of fold directed inwardly of said container, said joining elements, in the formed state of said container, overlapping said first and third side elements, respectively, on the respective inner surfaces thereof;

said second flap element, when in an operating position, forming an interference fit with said first and third side portions and abutting the inner surfaces of said securing sections of said first and third flap elements, thereby securing the position of such securing sections;

said fourth side portion including a fourth side element having the dimensions of said second side element and extending from the edge of said bottom portion opposite to that from which second side element extends;

said fourth side element being flexibly joined to proximate edges of said first and third side elements by respective second and fourth joining elements each including a bellows-type of fold directed inwardly of said container, said bellows-type of folds, in the formed state of said container, overlapping said first and third side elements, respectively, on the inner surfaces thereof;

said fourth side element having a flexibly-joined cover element extending from the edge of said fourth side element opposite to that joined to said bottom portion;

said cover element having outer dimensions approaching, but less than, those of said fourth side element, said cover element having left and right flap elements flexibly joined to opposing edges of said cover element, said left and right flap elements each having, in order, starting from the respective one of said opposing edges to which each flap element is attached, first and second edge-forming sections of equal length and a securing section, each of said first and second edge-forming sections being folded over the other section in its flap element to form an edge for said cover element, each of said securing sections having a length which is one-half of the width of said cover element, whereby, upon formation said cover securing sections lie in an abutting relationship to each other and lie on said cover element;

said cover element having a retainer portion extending from said cover element at the remaining edge thereof, said retainer portion comprising first and second flexibly connected retainer elements of equal length to each other and of equal width to said cover element, said first retainer element being closer to said cover element than said second retainer element, said retainer elements overlying each other in the formed state of said container; and, a pair of bellows-type retainer-joining portions joining opposite sides of said first retainer element to respective adjacent first edge-forming sections and overlying such sections when said container is formed.

2. Apparatus according to claim 1 in which said bottom, top and side sections are square and said container is a cube.

3. Apparatus according to claim 1 in which said flexible connections are formed by scoring.

4. Apparatus according to claim 3 in which selected ones of said flexible connections are double-scored.

5. Apparatus according to claim 1 in which selected ones of said flexible connections are formed by perforations.

6. Apparatus according to claim 1 in which the material of said container is cardboard.

* * * * *